US010215018B2

(12) United States Patent
Dikshit et al.

(10) Patent No.: US 10,215,018 B2
(45) Date of Patent: Feb. 26, 2019

(54) FLUID TRACER INSTALLATION

(71) Applicant: Schlumberger Technology Corporation, Sugar Land, TX (US)

(72) Inventors: Ashutosh Dikshit, Houston, TX (US); Bernard Yhuel, Pau (FR); Evgeny Anikanov, The Woodlands, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 501 days.

(21) Appl. No.: 14/591,681

(22) Filed: Jan. 7, 2015

(65) Prior Publication Data

US 2015/0192008 A1 Jul. 9, 2015

Related U.S. Application Data

(60) Provisional application No. 61/924,448, filed on Jan. 7, 2014.

(51) Int. Cl.
*E21B 47/10* (2012.01)
*E21B 47/01* (2012.01)

(52) U.S. Cl.
CPC ..... *E21B 47/1015* (2013.01); *E21B 47/01* (2013.01)

(58) Field of Classification Search
CPC ..... E21B 47/1015
See application file for complete search history.

(56) References Cited

U.S. PATENT DOCUMENTS 5,419,394 A 5/1995 Jones
6,681,854 B2 1/2004 Danos
6,752,207 B2 6/2004 Danos et al.
7,207,383 B2 4/2007 Hurst et al.
7,370,700 B2 5/2008 Hurst et al.
7,661,476 B2 2/2010 Yeh et al.
7,938,184 B2 5/2011 Yeh et al.
7,971,642 B2 7/2011 Yeh et al.
8,011,437 B2 9/2011 Yeh et al.
2011/0024111 A1* 2/2011 Moen ..... E21B 43/08 166/278
2011/0290480 A1 12/2011 Al-Gouhi et al.
2012/0118564 A1 5/2012 Gomes et al.
2013/0175024 A1 7/2013 Verret et al.
2013/0268198 A1 10/2013 Nyhavn

FOREIGN PATENT DOCUMENTS

EP 1416118 A1 5/2004

OTHER PUBLICATIONS

International Search Report and Written Opinion for corresponding PCT Application Serial No. PCT/US2015/010508, dated Apr. 15, 2015, 11 pages.

* cited by examiner

*Primary Examiner* — Nicole Coy
*Assistant Examiner* — Kristyn A Hall
(74) *Attorney, Agent, or Firm* — Kelly McKinney

(57) ABSTRACT

A shroud assembly that is conveyable within a wellbore extending into a subterranean formation via a tubular member. The shroud assembly and at least a portion of the tubular member at least partially define an annular volume around the tubular member. The shroud assembly includes apertures permitting fluid flow between the wellbore and the annular volume. A fluid tracer positioned within the annular volume is carried by flow of the fluid from the annular volume into the wellbore or tubular member.

19 Claims, 9 Drawing Sheets

FLUID TRACER INSTALLATION

CROSS-REFERENCE TO RELATED APPLICATION

This application claims the benefit under 35 U.S.C. § 119(e) of U.S. Provisional Patent Application 61/924,448 filed Jan. 7, 2014.

BACKGROUND OF THE DISCLOSURE

Tracers can be installed in conjunction with sand screens and/or other downhole devices, such as to aid in determining the inflow of oil, water, gas, and/or other fluids, and/or the source thereof. During manufacture, such tracers may be installed integral to the sand screens and/or other downhole devices, thus substantially preventing their removal prior to deployment downhole. It is also difficult to install such tracers in/on sand screens and/or other downhole devices that are not originally manufactured with the tracers, and doing so at the wellsite may present an even greater challenge.

SUMMARY OF THE DISCLOSURE

The present disclosure introduces a shroud assembly that is conveyable within a wellbore extending into a subterranean formation via a tubular member. The shroud assembly and at least a portion of the tubular member at least partially define an annular volume around the tubular member. The shroud assembly includes apertures permitting fluid flow between the wellbore and the annular volume. A fluid tracer positioned within the annular volume is carried by flow of the fluid from the annular volume into the wellbore or tubular member.

Additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
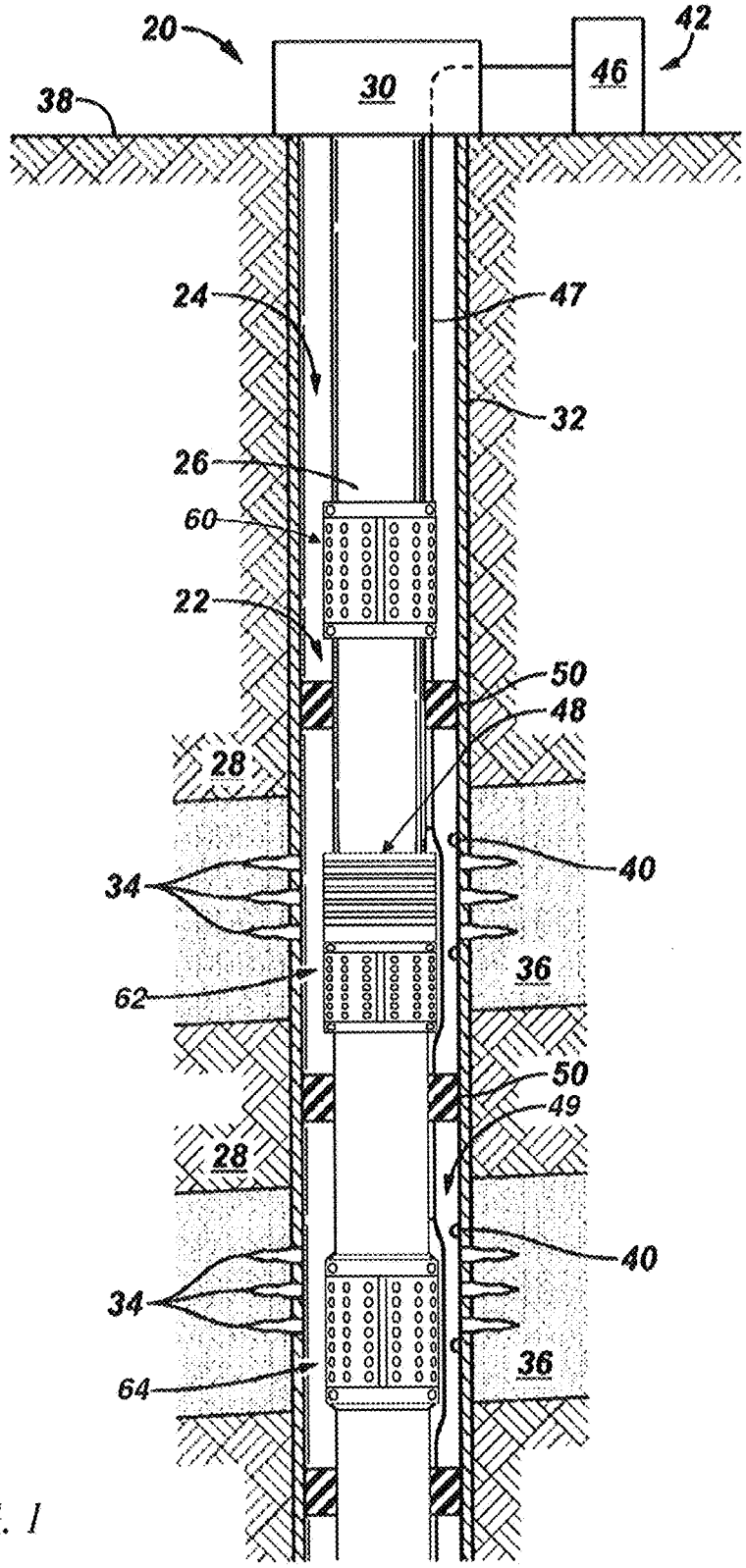
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of apparatus according to one or more aspects of the present disclosure, which may include a well system 20 comprising a completion 22 deployed in a wellbore 24. The wellbore 24 may be generally or substantially vertical as shown in FIG. 1, and also may be or comprise one or more horizontal, lateral, and/or otherwise non-vertical ("deviated") wells and/or well sections. The completion 22, which may be a production completion, may be conveyed within the wellbore 24 via a conveyance 26. The conveyance 26 may be or comprise production tubing, coiled tubing, and/or another conveyance comprising one or more substantially tubular members. The completion 22 may be conveyed to a desired location within the wellbore 24 relative to one or more subterranean formations 28 penetrated by the wellbore 24. The conveyance 26 may extend from a wellhead assembly 30 and/or other surface equipment. The completion 22 may be operable in a land based well or a subsea well within the scope of the present disclosure.

At least a portion of the wellbore 24 may be "open hole" or otherwise uncased or unlined. However, at least a portion of the wellbore 24 may be lined with a casing or liner 32 having perforations 34 proximate well zones 36 of one or more of the subterranean formation 28. The perforations 34 may establish a flow path for the flow of oil, gas, and/or other hydrocarbon-based fluids from one or more of the formations 28 into the wellbore 24 and into the completion 22. Such flow into the completion 22 may, for example, permit the production of the hydrocarbon-based fluids to a collection location, such as at the surface 38 of the well system 20.

The completion 22 or another portion of well system 20 comprises one or more tracer materials 40. For example, one or more of the tracer materials 40 comprised of various chemical species, electrically conductive materials, electically charged materials, magnetic materials, reactive materials, metallic materials, or otherwise detectable material or substances may be released when a given downhole component is sufficiently exposed to water or other substances, but may or may not be released in the presence of one or more hydrocarbon-based fluids. In a production application, among others within the present scope, the tracer materials may be released when exposed to a sufficient inflow of water from the surrounding formation 28. A sensor system 42 may be utilized to detect the released tracer material, and such detection may be utilized in determining the location or locations of water incursion.

The sensor system 42 may comprise one or more sensors 44 deployed along a longitudinal length of the completion 22. Depending on the type of tracer material 40 utilized in a given implementation, the sensors 44 may comprise temperature sensors, pH sensors, chemical sensors, electrical sensors, or other sensors operable in the detection of the tracer material at one or more locations. The sensor system 42 may comprise multiple independent sensors and/or a distributed sensor system. The sensor system 42 and/or another portion of the well system 20 may also comprise a processing system 46 coupled with the sensors 44, such as via one or more communication lines 47. The processing system 46 may be operable in the processing of data from the sensors 44, such as may be utilized in the determination of the one or more locations (e.g., zones 36) experiencing incursion of water.

The tracer materials 40 may be incorporated into and/or otherwise associated with one or more downhole components 48 of the well system 20, such as components of the completion 22. For example, the downhole components 48 may comprise screens, liners, actuators, and/or other components of the completion 22, including those that may at least partially form a flow path from the wellbore 24 into the completion 22. One or more of the downhole components 48 may be located between packers and/or other isolation devices 50, such as may isolate zones of the wellbore 24 adjacent corresponding zones 36. One or more of the tracer materials 40 may also be incorporated into portions of the casing or liner 32, such as proximate the locations at which hydrocarbon-based fluids flow from one or more of the formations 28 into the wellbore 24. The sensors 44 of sensor system 42 may be located in, along, and/or external to the completion 22, and the number of such sensors 44 may be sufficient to ensure detection of the released tracer materials 40.

The tracer materials 40 may also be contained within one or more instances of a shroud assembly positioned at various locations along the completion 22. For example, a shroud assembly 60 may be positioned about a section of the conveyance 26 that does not otherwise contain other components of the completion 22. Another shroud assembly 62 may be positioned adjacent or proximate one or more of the downhole components 48. Another shroud assembly 64 may be positioned around at least a portion of one or more other downhole components, such as those indicated in FIG. 1 by reference numeral 49. The downhole components 49 may be substantially the same as described above with respect to the downhole components 48, except that the downhole components 49 are partially or substantially covered by the surrounding shroud assembly 64. In various implementations, the shroud assembly 60 may be positioned on the completion 22 above a downhole component 48, such as sand screen, below the downhole component 48, or between two downhole components. In some embodiments the shroud assembly 60 overlays a joint.

The shroud assemblies 60, 62, and 64 may be substantially similar. However, implementations within the scope of the present disclosure may simultaneously utilize instances of the shroud assemblies 60, 62, and 64 that are not substantially similar but that vary in one or more characteristic. For example, the shroud assembly 60 may be longer than the shroud assembly 62, but may be shorter than the shroud assembly 64, in a direction parallel to the longitudinal axis of the completion 22. Other characteristics by which the shroud assemblies 60, 62, and 64 may differ relative to each other may include outside diameter, material composition, number and/or location of apertures permitting fluid flow in/out of the shroud assembly 64 (such as the apertures 72 described below), means of being affixed to the conveyance 26, and the number and/or location(s) of the tracer materials 40, among others within the scope of the present disclosure. Nonetheless, description of one of the shroud assemblies 60, 62, and 64 that follows is applicable or readily adaptable to the others unless explicitly noted otherwise.

Figure 2:
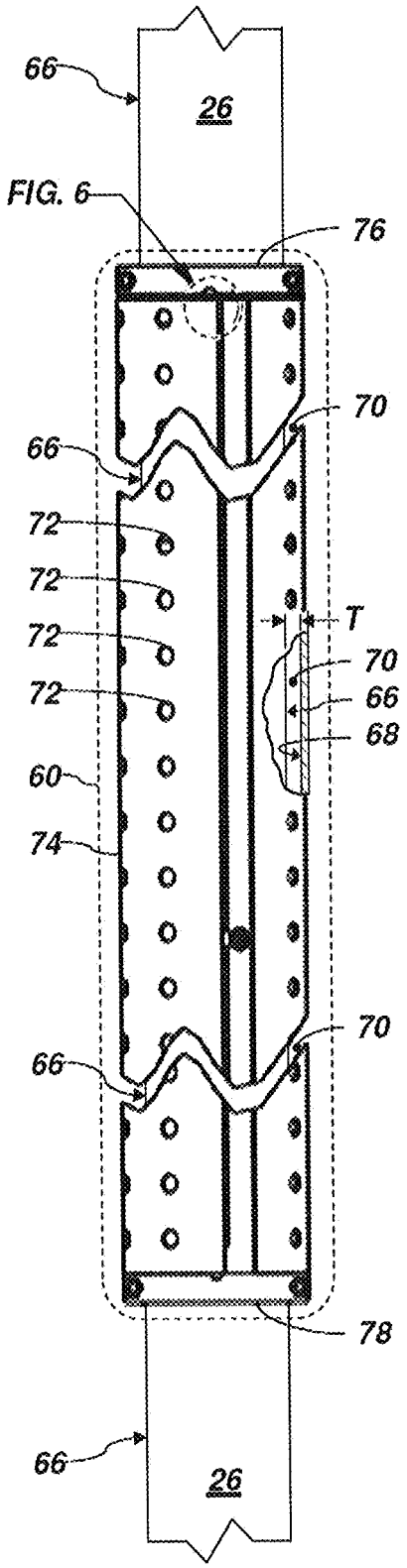
FIG. 2 is a schematic view of a portion of the apparatus shown in FIG. 1.

FIG. 2 is an enlarged view of a portion of the completion 22 shown in FIG. 1, including the shroud assembly 60 and a portion of the conveyance 26. The depicted portion of the conveyance 26 may be or comprise a tubular member extending substantially continuously through the shroud assembly 60. The conveyance 26 may also be or comprise two or more tubular members joined together and collectively extending through the shroud assembly 60. For example, the two or more tubular members may terminate at cooperating pin- and box-ends operable to threadedly couple the tubular members together. The coupling of the two or more tubular members may also utilize a third component, such as a clamp and/or other device that may be or comprise one or more discrete members coupled detachably (e.g., by one or more threads, pins, keys, etc.) or substantially permanently (e.g., by welding, brazing, interference fit, adhesive, etc.) to one or both of the two or more tubular members. In some implementations, the conveyance or tubular member 26 may at least partially comprise the blank tubing section of a sand screen assembly. The blank tubing section may comprise the entire length of the conveyance 26 overlayed by the shroud assembly 60 or only a portion. The blank tubing section may be coupled to another tubular or to the blank tubing section of another sand screen assembly. In some implementations, the portion of the conveyance 26 underlying the shroud assembly deos not include a flow path between the exterior and interior of the conveyance 26.

The shroud assembly 60 is attachable to the tubular member or conveyance 26. As shown in FIG. 2 the shroud assembly 60 is affixed to an exterior 66 of the conveyance 26, such that an interior 68 of the shroud assembly 60 and the exterior 66 of the conveyance 26 at least partially define an annular volume 70 extending around the conveyance 26. The radial thickness T of the annular volume 70 may range between about 0.5 cm and about 5.0 cm, such as about 2.5 cm, although other dimensions are also within the scope of the present disclosure.

Referring to FIGS. 1 and 2, collectively, the shroud assembly 60 includes a plurality of apertures 72 permitting fluid flow between the wellbore 24 and the annular volume 70. The apertures 72 are depicted in the figures as being substantially circular, although other geometric and/or irregular shapes are also within the scope of the present disclosure, including implementations in which the apertures 72 are elongated, perhaps resembling slots extending longitudinally along the shroud assembly 60, radially around the shroud assembly, combinations thereof, and/or other shapes.

The shroud assembly 60 may comprise a shroud 74 extending between a first stop ring 76 and a second stop ring 78. The first and second stop rings 76 and 78, respectively, may be secured around the exterior 66 of the conveyance 26 by various means described below. The tracer materials 40 may initially be affixed to the interior 68 of the shroud assembly 60, such as to an interior surface 80 of the shroud 74. The tracer materials 40 may also or instead be affixed, initially, to the exterior 66 of the conveyance 26.

Figure 3:
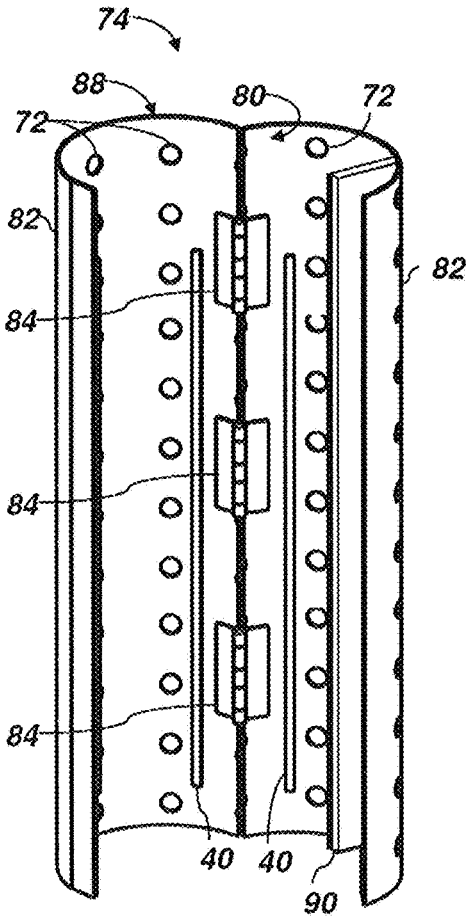
FIG. 3 is a perspective view of a portion of the apparatus shown in FIGS. 1 and 2.
Figure 4:
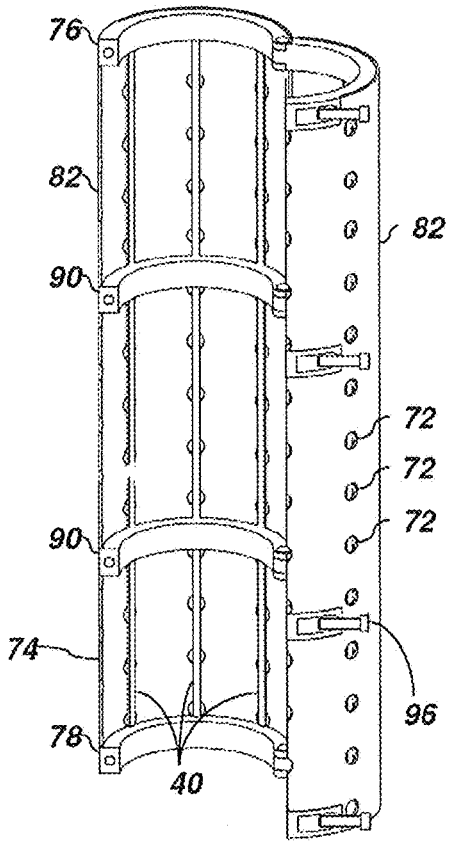
FIG. 4 is a perspective view of another implementation of the apparatus shown in FIG. 3.
Figure 5:
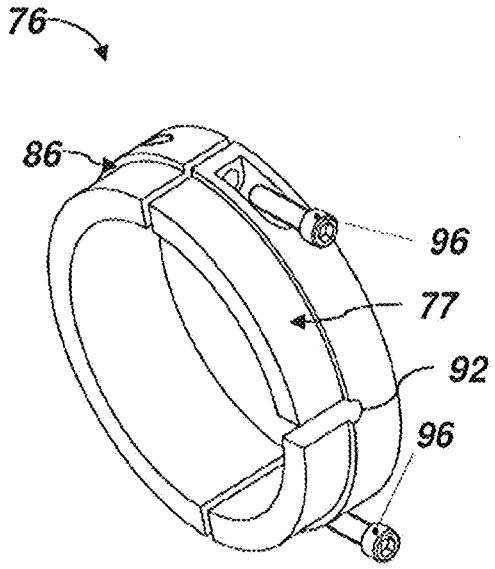
FIG. 5 is a perspective view of a portion of the apparatus shown in FIGS. 1 and 2.

FIGS. 3 and 4 are perspective views of example implementations of the shroud 74 shown in FIGS. 1 and 2 according to one or more aspects of the present disclosure. The tracer materials 40 may be elongated members adhered to the interior surface 80 of the shroud 74. As depicted in FIG. 3, the tracer materials 40 may be positioned between the apertures 72, such that the tracer materials 40 do not substantially impede fluid flow through the apertures 72. As depicted in FIG. 4, however, the tracer materials 40 may be aligned with the apertures 72 in a manner that initially substantially impedes fluid flow through the apertures 72. In similar implementations, one or more of the tracer materials 40 may be positioned between the apertures 72, as shown in FIG. 3, while another one or more of the tracer materials 40 may be aligned with the apertures 72, as shown in FIG. 4. The shroud assembly 60 is attachable to the conveyance 26 by any know mechanism. FIGS. 3, 4, and 5 provide several perspective examples of implementations to attach the shroud assembly. However, these examples do not intended to provide an exhaustive list and additional mechanisms are with the purview of this disclosure. FIGS. 3 and 4 demonstrate that the shroud 74, and perhaps the shroud assembly 60, may resemble a clamshell arrangement.

For example, referring to FIG. 3, the shroud 74 may comprise arcuate, half-cylindrical, and/or otherwise shaped halves 82 joined together by one or more hinges 84. Various fastening means may be utilized to subsequently maintain the halves closed together after assembly to the conveyance 26.

Figure 6:
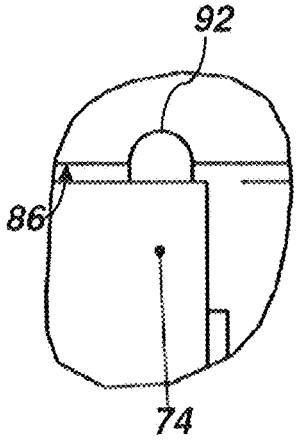
FIG. 6 is an enlarged view of a portion of the apparatus shown in FIGS. 1 and 2.

FIG. 5 is a perspective view of an example implementation of the first stop ring 76 shown in FIG. 2, although the following description pertaining to the first stop ring 76 is applicable or readily adaptable to also describing the second stop ring 78. Referring to FIGS. 2, 3, and 5, collectively, the first stop ring 76 may comprise a shoulder 86 that may abut or be positioned proximate an end surface 88 of the shroud 74 and/or otherwise aid in aligning the shroud 74 and the first stop ring 76 relative to each other. When assembled, the interior surface 80 of the shroud 74 may extend circumferentially around a corresponding surface 77 of the first stop ring 76. An alignment member 90, which may extend radially inward from the interior surface 80 of the shroud 74, may also encourage relative alignment of the shroud 74 and the first stop ring 76. The alignment member 90 may engage with a corresponding slot, recess, notch, and/or other feature 92 of the first stop ring 76, as shown in FIG. 6, which is an enlarged view of a corresponding portion of FIG. 2. Such engagement may also aid in preventing rotation of the shroud 74 relative to the first and second stop rings 76 and, thus, the conveyance 26.

An example assembly process may entail affixing the first stop ring 76 to the conveyance 26 and then affixing the shroud 74 to the first stop ring 76. The second stop ring 76 may be similarly affixed to the conveyance 26 before or after affixing the shroud 74 to the first stop ring 76. The first and second stop rings 76 and 78 may each comprise arcuate, half-cylindrical, and/or otherwise shaped portions 94 joined together by two or more fasteners 96 operable to impart a clamping force around the conveyance 26 by the first and second stop rings 76 and 78, such that friction and/or an interference fit maintain the axial positions of the first and second stop rings 76 and 78 once affixed to the conveyance 26. The fasteners 96 are depicted in FIG. 5 as cap screws that will extend through corresponding passages of one of the portions 94 and threadedly couple with threaded passages or holes of the other one of the portions 94. However, other fasteners are also within the scope of the present disclosure.

The example implementation shown in FIG. 4 is substantially similar to the implementation depicted in FIG. 3. However, FIG. 4 further demonstrates that additional rings 98 may be utilized between the first and second stop rings 76 and 78, and that such rings 76, 78, and 98 may be hinged. FIG. 4 also demonstrates that the shroud 74 may be substantially permanently affixed to the rings 76, 78, and 98, such as by welding, adhesive, and/or other means.

Various components of the example implementations depicted in one or more of FIGS. 2-6 comprise two cooperating portions (e.g., halves) that are fastened together around the conveyance 26. However, other implementations within the scope of the present disclosure may include more than two portions, whether such portions are fastened together via fasteners, hinges, and/or other means. One or more aspects of the example implementations shown in one or more of FIGS. 2-6 may also be substantially similar to, utilized with, applicable to, and/or adaptable for utilization with the OPTIPAC gravel-packing systems commercially available from SCHLUMBERGER.

Figure 7:
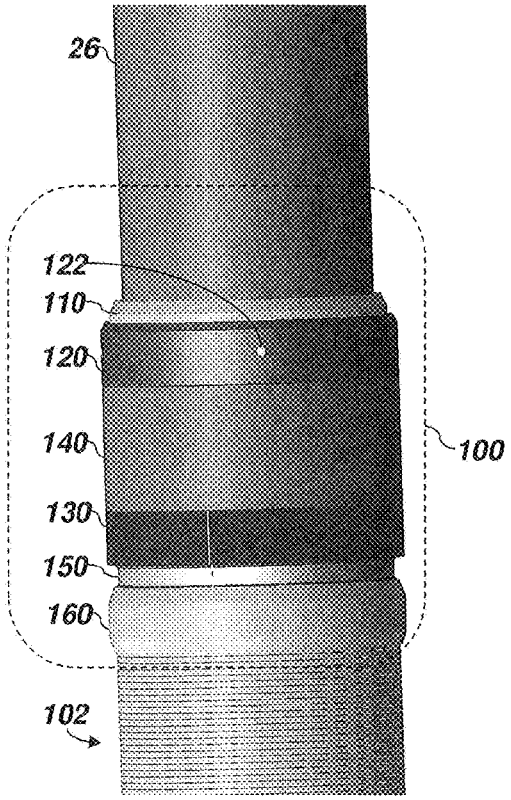
FIG. 7 is a schematic view of a portion of the apparatus shown in FIGS. 1 and 2.
Figure 8:
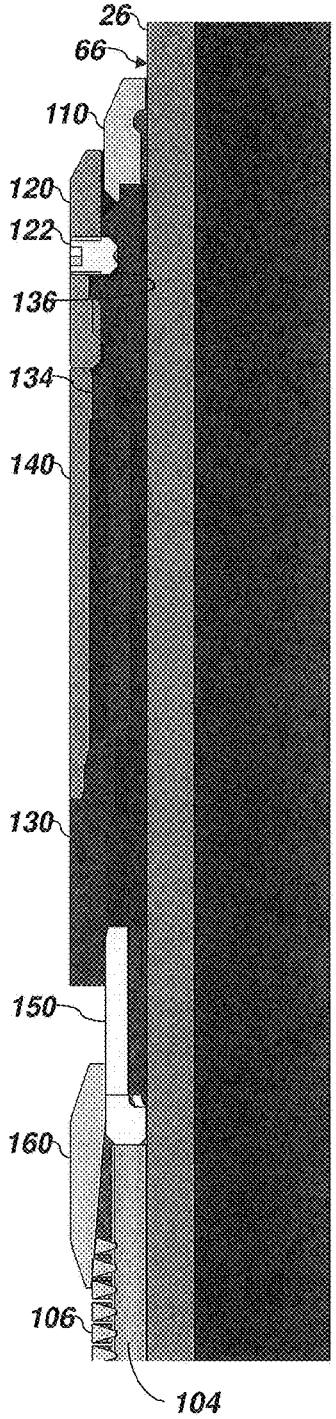
FIG. 8 is a sectional view of the apparatus shown in FIG. 7.

FIG. 7 is a schematic view of a portion of an example implementation of a shroud assembly 100 having one or more aspects in common with the shroud assemblies 62 and/or 64 shown in FIG. 1, and/or with the shroud assembly 60 shown in one or more of FIGS. 1-6. FIG. 8 is a sectional view of a portion of the shroud assembly 100 shown in FIG. 7.

The shroud assembly 100 may be installed adjacent a downhole component 102, which may be substantially similar to one or more of the downhole components 48 and 49 shown in FIG. 1. For example, referring to FIGS. 1, 7, and 8, collectively, the downhole component 102 may be or comprise a sand screen and/or other filtering element through which hydrocarbon-based fluids in the wellbore 24 may flow. Accordingly, the downhole component 102 may be in a flow path of fluid extending from one of more of the formations 28, into the wellbore, through the downhole component 102, and into an interior passage of the conveyance 26 via one or more ports (not shown) aligned with the downhole component 102 and/or the shroud assembly 100.

Where the downhole component 48 or 102 is or comprises a sand screen and/or other filtering element, such filtering element may remove sand and/or other particulate from the fluid flowing along the flow path into the conveyance 26. For example, a plurality of members 104 may extend axially along the exterior 66 of the conveyance 26, and one or more wires and/or other members 106 may wrap circumferentially around the axial members 104. Consequently, a plurality of axial flow channels 108 may be defined between the exterior 66 of the conveyance 26, the axial members 104, and the circumferential members 106. The conveyance 26 of the sand screen assembly or filter element may be a blank section of tubing to be joined with other tubing sections to form the tubing member to which the shroud assembly 60 may be attachable.

The shroud assembly 100 may comprise an inner ring 110, a lock ring 120, an inner sleeve 130, an outer sleeve 140, a bypass ring 150, and an outer ring 160, each extending around the conveyance 26. Interference fit, welding, one or more fasteners, and/or other means detachably or substantially permanently couple the inner ring 110 to the exterior 66 of the conveyance 26, the inner sleeve 130 to the inner ring 110, the bypass ring 150 to the inner sleeve 130, and/or the outer ring 160 to the bypass ring 150. The outer sleeve 140 slides over the inner sleeve 130 to the position shown in FIGS. 7 and 8, and is held there by the lock ring 120. Threads, one or more fasteners, and/or other means detachably couple the lock ring 120 to the inner sleeve 130. One or more set screws and/or other fasteners 142 may fix the position of the lock ring 120 relative to the inner sleeve 130.

Figure 9:
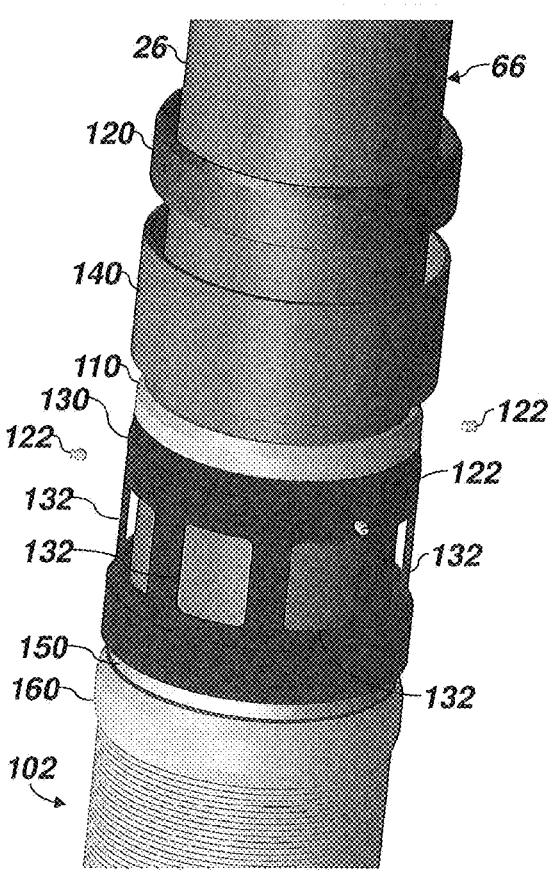
FIG. 9 is a schematic view of the apparatus shown in FIG. 7 in an intermediate stage of tracer installation.
Figure 10:
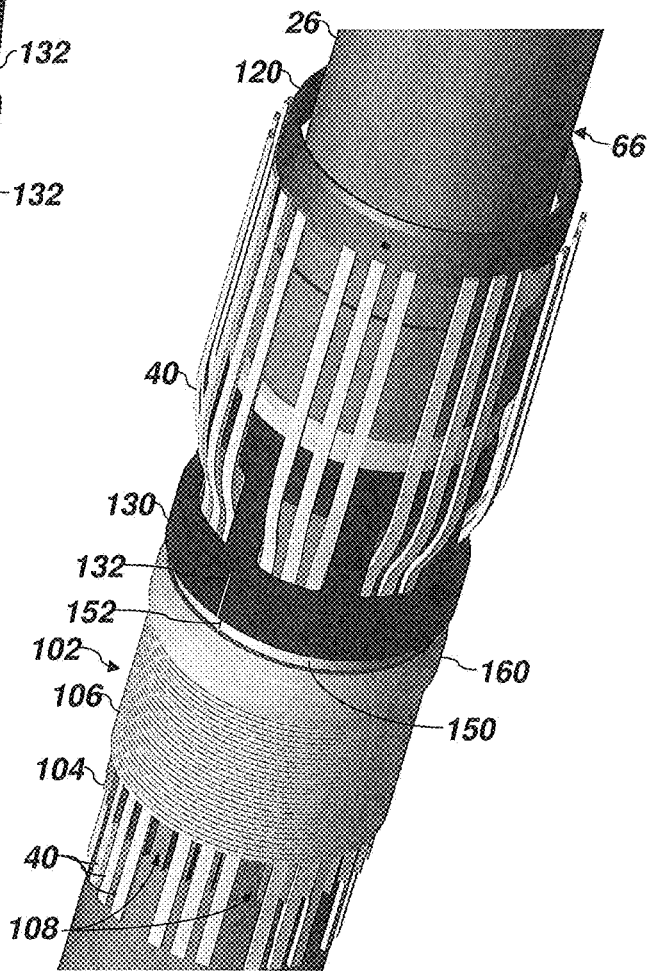
FIG. 10 is a schematic view of the apparatus shown in FIG. 9 in a subsequent stage of tracer installation.

FIGS. 9 and 10 are schematic views of the apparatus shown in FIGS. 8 and 9 in sequential stages of the installation of tracer materials 40. For example, in FIG. 9, the fasteners 122 have been removed from the lock ring 120, thus permitting the lock ring 120 to be translated axially away from the inner sleeve 130 (although merely loosening the fasteners 122 may be sufficient in some implementations). Accordingly, the outer sleeve 140 may also be translated axially away from the inner sleeve 130, thus revealing a plurality of windows 132 collectively extending circumferentially around a central portion of the inner sleeve 130.

Thereafter, as shown in FIG. 10, the tracer materials 40 may be installed. For example, the tracer materials 140 may be or comprise elongated members having sufficient flexibility so as to allow their insertion through the windows 132 of the inner sleeve 130, and then through corresponding channels (not shown) collectively defined by an interior profile of the bypass ring 150 and the exterior 66 of the conveyance 26, until the flexible member is received within a corresponding one of the flow channels 108. The stage depicted in FIG. 10 may be an intermediate stage, depicting the flexible members being partially installed within the corresponding flow channels 108, such that the flexible members may subsequently be substantially received within the flow channels 108.

The shroud assembly 100 may then be reassembled. For example, the outer sleeve 140 may again be positioned over the inner sleeve 130, thus covering the windows 132. The lock ring 120 may then be reaffixed to the inner sleeve 130, and the fasteners 122 may be reinstalled through the lock ring 120, whether to abut against an outer profile 134 of the inner sleeve 130 or, as depicted in FIG. 8, to be received within corresponding recesses 136 of the outer profile 134. The fasteners 122 may threadedly engage with the lock ring 120, the recesses 136 of the inner sleeve 130, or both. Consequently, the shroud assembly 100 may again appear as depicted in FIG. 7.

Figure 11:
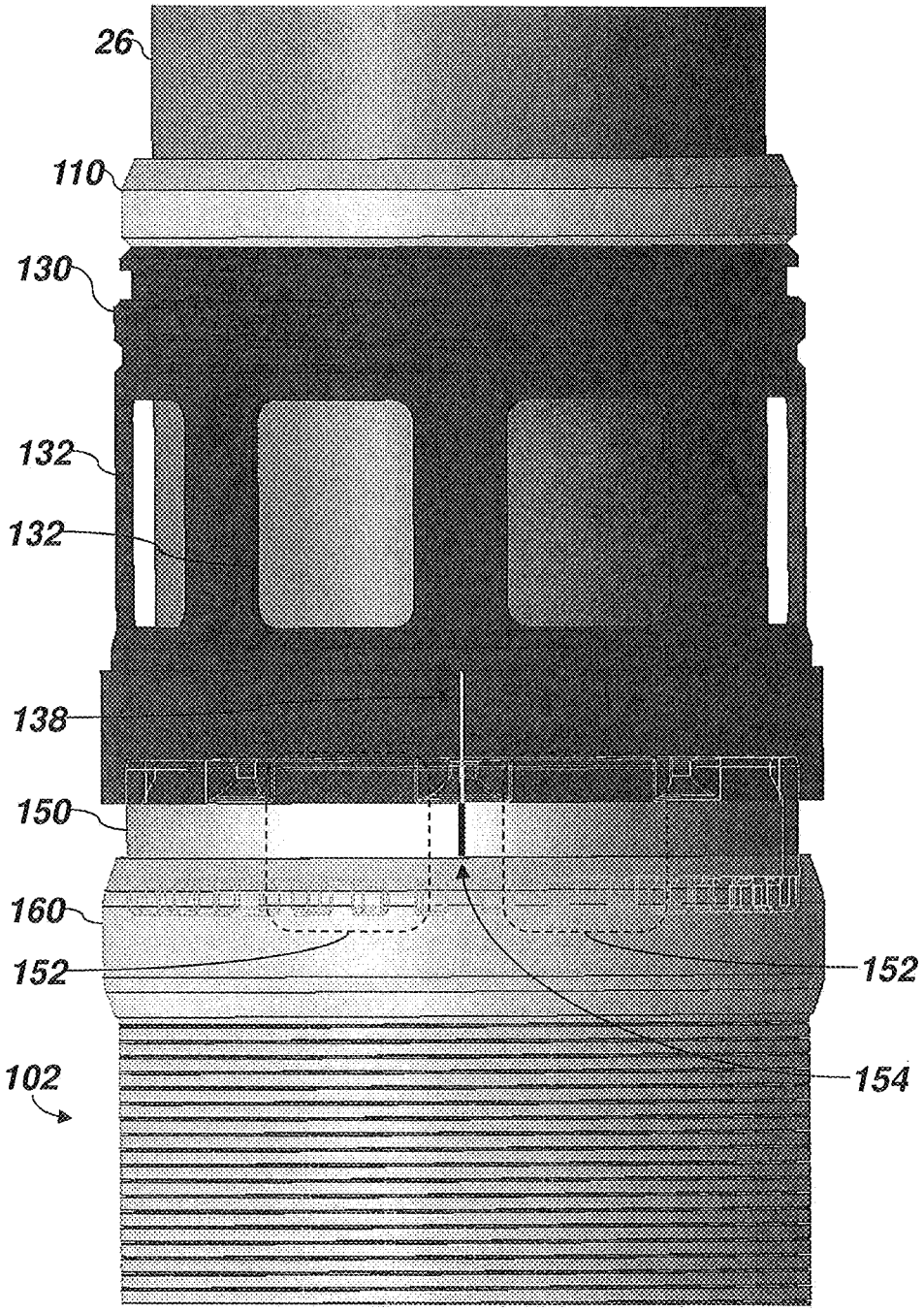
FIG. 11 is a schematic view of a portion of the apparatus shown in FIG. 7.

FIG. 11 is a schematic view of the shroud assembly 100 shown in FIGS. 7-10 but excluding the lock ring 120 and the outer sleeve 140. Moreover, the bypass ring 150 is depicted in outline, so as to illustrate an example implementation of the channels 152 through which the tracer materials 40 (as shown in FIG. 10) may pass during installation. The channels 152 may substantially correspond in number and size to the windows 132 of the inner sleeve 130. FIGS. 10 and 11 also illustrate that the inner sleeve 130 may have one or more alignment marks 138, and that the bypass ring 150 may have one or more corresponding alignment marks 154. The one or more alignment marks 138 may substantially align with the corresponding alignment marks 154 when the windows 132 of the inner sleeve 130 are substantially aligned with the channels 152 of the bypass ring 150.

Figure 12:
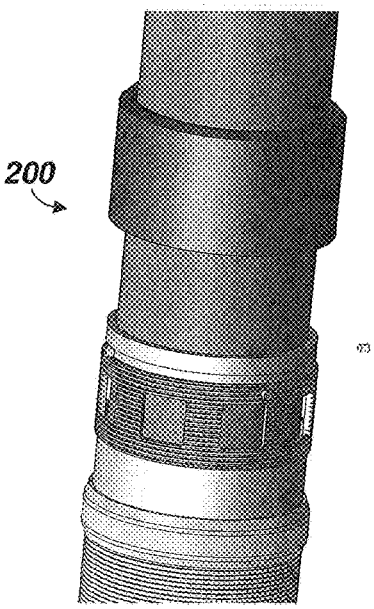
FIG. 12 is a schematic view of another implementation of the apparatus shown in FIG. 7.
Figure 13:
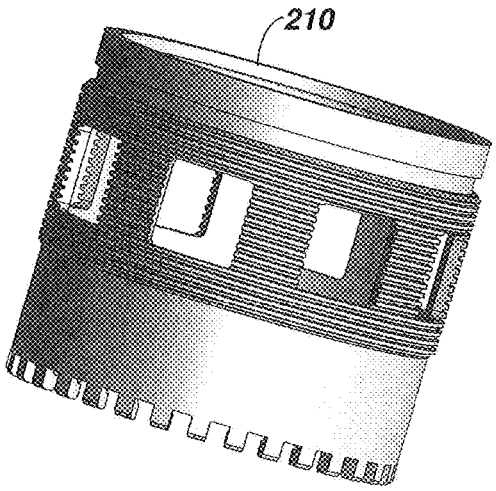
FIG. 13 is a schematic view of a portion of the apparatus shown in FIG. 12.
Figure 14:
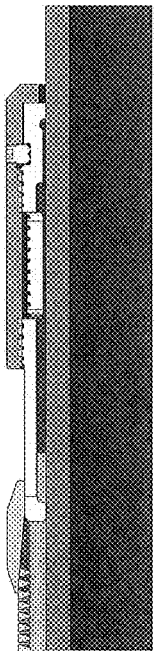
FIG. 14 is a sectional view of the apparatus shown in FIG. 12.
Figure 15:
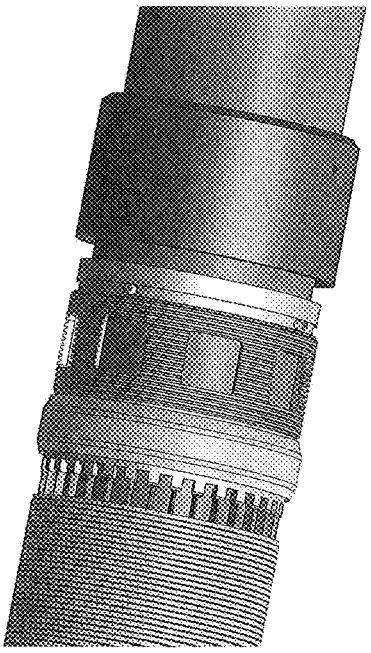
FIG. 15 is a schematic view of the apparatus shown in FIG. 12 in a subsequent stage of tracer installation.

FIG. 12 is a schematic view of another implementation of the shroud assembly 100 shown in FIGS. 7-11, hereinafter designated by the reference numeral 200. The shroud assembly 200 may be substantially similar to the shroud assembly 100 shown in FIGS. 7-11. However, two or more components of the shroud assembly 100 may be integrally formed as a discrete member 210 in the shroud assembly 200, as shown in FIG. 13. FIG. 14 is a sectional view of the shroud assembly 200. FIG. 15 is a schematic view of the shroud assembly 200 shown in FIG. 12 in a subsequent stage of assembly.

Figure 16:
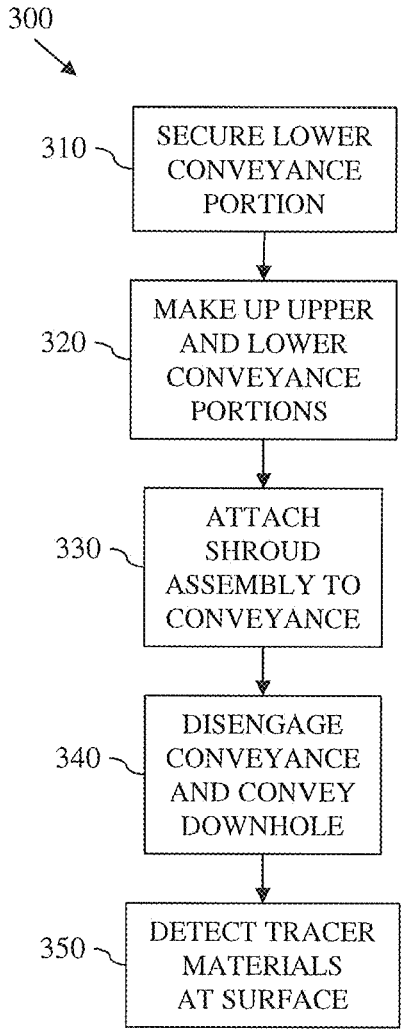
FIG. 16 is a flow-chart diagram of at least a portion of a method according to one or more aspects of the present disclosure.

FIG. 16 is a flow-chart diagram of at least a portion of a method (300) according to one or more aspects of the present disclosure. The method (300) may be executed, at least in part, utilizing the well system 20 shown in FIG. 1. The method (300) includes securing (310) a lower portion of a conveyance, such as the conveyance 26 described above. For example, securing (310) the lower portion of the conveyance may comprise engaging the lower conveyance portion with slips and/or other means at the surface of the wellsite.

An upper portion of the conveyance may then be made up (320) with the lower conveyance portion. For example, the upper and lower conveyance portions may be threadedly engaged, whether alone or via utilization of one or more additional components. A shroud assembly may then be assembled (330) to the conveyance. The shroud assembly may be substantially similar to the shroud assembly 100 shown in FIGS. 1-11, the shroud assembly 200 shown in FIGS. 12-15, and/or others within the scope of the present disclosure.

The conveyance may then be disengaged at the surface and subsequently conveyed (340) within the borehole for positioning relative to one or more subterranean formations. Downhole and/or surface equipment may then be utilized to detect (350) tracer materials carried with fluid flow away from the shroud assembly.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a shroud assembly conveyable within a wellbore extending into a subterranean formation via a tubular member, wherein the shroud assembly is attachable to at least a portion of the tubular member at least partially defining an annular volume around the tubular member, and wherein the shroud assembly comprises:

a plurality of apertures permitting fluid flow between the wellbore and the annular volume; and a first stop ring axially displaceable along the tubular member to allow installation of a fluid tracer through the plurality of apertures and securable around an exterior of the tubular member to cover the plurality of apertures, such that the first stop ring is unsecured from the tubular member and then re-secured to the tubular member during installation of the fluid tracer; wherein the fluid tracer is conveyable within the wellbore within the shroud assembly and carriable by flow of the fluid from the annular volume into the wellbore or tubular member.

2. The apparatus of claim 1 further comprising the tubular member.

3. The apparatus of claim 2 further comprising a flow path from the wellbore into an interior of the tubular member.

4. The apparatus of claim 3 further comprising a filter element partially defining the flow path.

5. The apparatus of claim 4 wherein the shroud assembly and fluid tracer are spaced apart from the filter element relative to a longitudinal axis of the tubular member.

6. The apparatus of claim 4 wherein the apertures of the shroud assembly partially define the flow path.

7. The apparatus of claim 2 wherein the tubular member comprises two sections of tubing coupled together to form a joint.

8. The apparatus of claim 7 wherein the tubular member is at least partially comprised of a blank tubing section of a sand screen assembly.

9. The apparatus of claim 7 where in the shroud assembly overlays the joint.

10. The apparatus of claim 1 wherein the shroud assembly comprises:

a second stop ring secured around the exterior of the tubular member; and a shroud extending between the first and second stop rings.

11. The apparatus of claim 10 wherein the first and second stop rings partially define the annular volume.

12. The apparatus of claim 1 where in the shroud assembly comprises two halves shaped to be joined together about the tubular member and impart a clamping force on the tubular member.

13. The apparatus of claim 12 wherein the two halves are joined by at least one hinge.

14. A method, comprising:

attaching a shroud assembly to a tubular member, thereby at least partially defining an annular volume around the tubular member, the shroud assembly comprising a stop ring secured to the tubular member;

unsecuring the stop ring;

axially displacing the stop ring along the tubular member to expose a plurality of apertures;

disposing a fluid tracer in the annular volume via the plurality of apertures;

securing the stop ring to the tubular member thereby covering the plurality of apertures; and conveying the tubular member and shroud assembly within a wellbore extending into a subterranean formation, wherein the plurality of apertures permits fluid flow between the wellbore and the annular volume.

15. The method claim 14 further comprising attaching the shroud to the tubular member adjacent a filter element on the tubular member.

16. The method of claim 14 further comprising attaching the shroud to the tubular member between two filter elements on the tubular member.

17. The method of claim 14 further comprising forming the tubular member by joining two sections of tubing to form a joint.

18. The method of claim 17 further comprising attaching the shroud to the tubular member such that the shroud overlays the joint.

19. The method of claim 14 further comprising detecting an existence of a portion of the fluid tracer in a fluid flow from the annular member.

* * * * *